US007611360B2

(12) United States Patent
Akahori et al.

(10) Patent No.: US 7,611,360 B2
(45) Date of Patent: Nov. 3, 2009

(54) TERMINAL LOCK DEVICE FOR SCREW LOCK TERMINAL

(75) Inventors: Masahiro Akahori, Shizuoka (JP); Takao Nogaki, Shizuoka (JP); Toshinori Iwai, Shizuoka (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 12/385,187

(22) Filed: Apr. 1, 2009

(65) Prior Publication Data

US 2009/0253294 A1 Oct. 8, 2009

(30) Foreign Application Priority Data

Apr. 3, 2008 (JP) ..... 2008-097414

(51) Int. Cl.
*H01R 12/00* (2006.01)

(52) U.S. Cl. ..... 439/76.2; 439/883; 439/801

(58) Field of Classification Search ..... 439/76.2, 439/949, 883, 801, 813
See application file for complete search history.

(56) References Cited

U.S. PATENT DOCUMENTS 7,442,099 B2 * 10/2008 Egawa et al. ..... 439/883

* cited by examiner

*Primary Examiner*—Tho D Ta
(74) *Attorney, Agent, or Firm*—Edwards Angell Palmer & Dodge LLP

(57) ABSTRACT

For preventing incomplete lock of a terminal at lock leaves of a connection box main body, and locking the terminal smoothly and securely at the lock leaves, a terminal lock device includes a connection box main body made of insulation resin, having a surrounding wall for receiving a terminal, and a pair of flexible lock leaves in the surrounding wall. A tab of the terminal with an electric wire is structured for inserting a head of a bolt. The tab is locked at the lock leaves. The terminal is connected to a mating circuit by screwing. A cover includes projecting plates, which are respectively inserted into bending spaces for bending the lock leaves when the cover is attached at the connection box main body. A pair of wall ribs is provided adjacent to the lock leaves, and a pair of tab ribs is provided at both ends of the tab.

3 Claims, 5 Drawing Sheets

TERMINAL LOCK DEVICE FOR SCREW LOCK TERMINAL

The priority application Number Japan Patent Application 2008-097141 upon which this patent application is based is hereby incorporated by reference.

BACKGROUND OF THE INVENTION

1. Field of the Invention

This invention relates to a terminal lock device for a screw lock terminal, which locks the terminal with an electric wire for a power supply in an electric connection box and connects the terminal to an electric circuit such as a bus bar by screw locking with a bolt in such condition.

2. Description of the Related Art

FIG. 6 shows an example of a terminal lock device for a screw lock terminal by prior art (refer Patent Document 1).

The terminal lock device includes a terminal block 62 of a connection box main body 61 (a fuse block main body) made of insulation resign. A bus bar (not shown) is arranged at the terminal block 62, and a horizontal plate portion 68 of the screw lock terminal 63 with an electric wire is arranged on the bus bar. A vertical tab portion 64 of the screw lock terminal 63 is temporarily locked by a pair of lock hooks 65 provided symmetrically in a horizontal direction of the connection box main body 61. In such condition, a bolt 66 is inserted through a slot hole of the terminal 63 and a hole of the bus bar, and screwed into a nut (not shown) at the terminal block 62, so that the terminal 63 is connected to the bus bar.

The tab portion 64 of the terminal 63 extends vertically, and an opening 67 at the tab portion 64 continues the slot hole at the horizontal plate portion 68 of the terminal 63. A wire crimp portion 69 is provided at a vertical base portion bent perpendicularly from the plate portion 68. A bolt shaft portion of the temporarily locked bolt 66 is engaged slidingly through the opening 67 with the slot hole, and the bolt 66 will be completely locked. The pair of lock hooks 65 is projectingly arranged symmetrically in the horizontal direction from a vertical wall of the connection box main body 61, and penetrates into the opening 67 of the tab 64 and engages with right/left ends of the tab 64. A top end of the tab 64 abuts on a rib 70 of the wall.

An electric wire 71 joined with the wire crimp portion 69 of the terminal 63 is connected with an alternator of a vehicle or the like. The bus bar is connected with a fusible link (not shown) in the connection main box, and the fusible link is connected to a load side by the other electric wires 72 with a terminal. The connection box main body 61 is arranged together with a relay, a fuse and a connector in an outer main body (not shown) made of synthetic resin. A cover (not shown) is provided at the outer main body so as to form the electric connection box. Japan Patent published application document No. 2006-4733 is referred.

SUMMARY OF THE INVENTION

Objects to be Solved

According to the above terminal lock device of the screw lock terminal, there are problems that, when the terminal 63 is engaged slidingly with the temporarily locked bolt 66, and the terminal 63 is pushed unsatisfactorily (the lock hook 65 is incompletely fitted in the tab 64), a contact area between the terminal 63 and the bus bar decreases in result to affect electric contact, and the terminal 63 is rotated by screwing the bolt 66 in result to displace the terminal 63 or interfere with others, and the terminal 63 is easily removed from the bolt 66 by vibration.

When the terminal 63 is slid along the bolt 66 so as to engage the tab 64 and the lock hook 65, there is a problem that the terminal 63 is not smoothly engaged by the tab 64 abutting on the lock hook 65. When inserting or gouging the tab 64 slantingly to the lock hook 65, the tab 64 may be disengaged.

According to the above problems, an object of the present invention is to provide a terminal lock device for a screw lock terminal, which can temporarily lock the terminal at a lock hook so as to prevent incomplete engagement of the terminal and a connection box main body in an electric connection box and fasten the terminal at the lock pad efficiently, smoothly and securely.

How to Attain the Object of the Present Invention

In order to overcome the above problems and attain the object of the present invention, a terminal lock device for a screw lock terminal according to the present invention includes a connection box main body made of an insulation resin, a surrounding wall, and a pair of flexible lock leaves at the surrounding wall. A tab of a terminal with an electric wire is locked at the lock leaves, the tab being for inserting a head of a bolt therethrough. The terminal is connected to a mating circuit by screwing. A cover covering the terminal is mounted at the connection box main body, and a projecting plate of the cover penetrates into a bending space for bending the lock leaf.

According to the above structure, when the terminal is inserted slidingly in the surrounding wall so as to engage the tab to the lock leaves, and the lock leaves are maintained to be bent because of incomplete insertion, the projecting plate of the cover abuts on the lock leaves and the cover cannot be attached at the connection box main body. Operator can detect the incomplete insertion by this condition. Therefore, when the tab is lock completely at the lock leaves, the cover can be attach at the connection box main body. Thus, the terminal is inserted along a bus bar as the mating circuit into the surrounding wall.

The terminal lock device for the screw lock terminal according to the present invention further includes a pair of wall ribs at the surrounding wall adjacent to the lock leaves, and a pair of tab ribs at both side of the tab, and when the terminal is locked at the lock leaves, inner surfaces of the wall ribs and outer surfaces of the tab ribs touch to each other.

According to the above structure, since the inner surfaces of the wall ribs and the outer surfaces of the tab ribs contact when the terminal is inserted completely into the surrounding wall and locked completely at the lock leaves, the tab ribs are stably supported by the wall ribs. Thereby, the terminal is locked in a rotational direction of screwing the bolt, and positioned accurately in surrounding wall, so that the terminal is locked securely and tightly at the lock leaves.

The terminal lock device for the screw lock terminal according to the present invention is characterized in that the tab is continued to the outer surface of the tab ribs by a curved surface.

According to the above structure, the tab and the tab ribs of the terminal are continued smoothly by the curved surface to each other, so that when the terminal is inserted into the surround wall, the curved surface slides about the lock leaves by a small friction force, and the terminal is inserted and locked smoothly.

EFFECTS OF THE INVENTION

According to the terminal lock device of the present invention, since the cover cannot be attached when the terminal is incompletely locked, the incomplete lock can be securely detected. Thereby, the operator can retry to lock the terminal completely so as to prevent incomplete insertion. Therefore, a required contact area of the terminal and the bus bar as the mating circuit is ensured and electric connection is maintained in a good condition, and unexpected removing the terminal caused by incomplete insertion can be prevented, and reliability of the electric connection is improved.

According to the terminal lock device of the present invention, the terminal is locked and the tab ribs abut on the wall ribs by surface contact. Thereby, the terminal is prevented from moving in the rotational direction, and a lock force is applied securely. Thus, the bolt can be prevented from removing and the above effects are improved.

According to the terminal lock device of the present invention, the terminal can be slid and touched at the curved surface thereof onto the lock leaves, and locked easily by a small force. Thus, productivity of assembling the terminal to the connection box main body is improved.

The above and other objects and features of this invention will become more apparent from the following description taken in conjunction with the accompanying drawings.

DESCRIPTION OF THE PREFERRED EMBODIMENT

Figure 1:
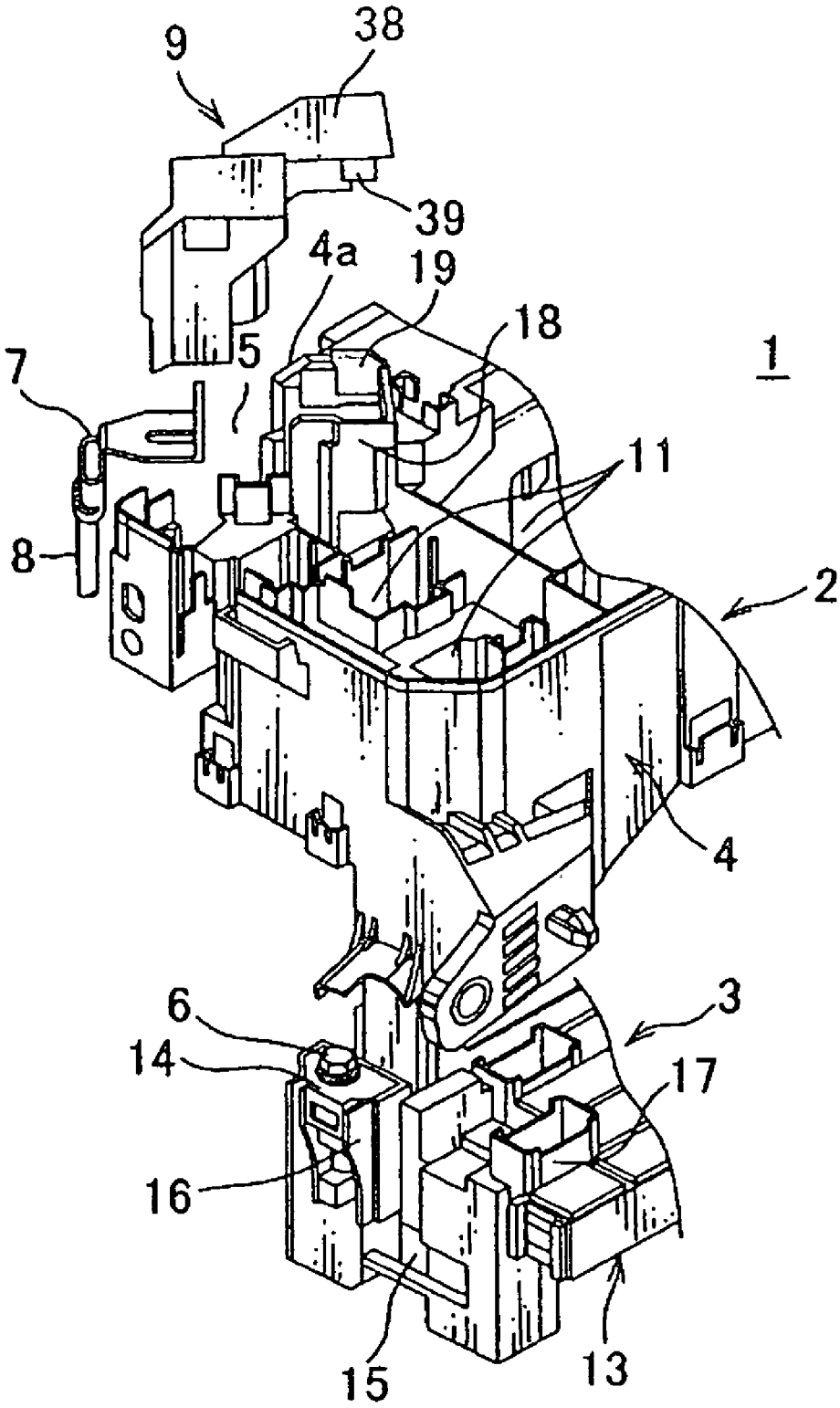
FIG. 1 is an exploded perspective view of an electric connection box including a terminal lock device for a screw lock terminal of a first embodiment according to the present invention.
Figure 2:
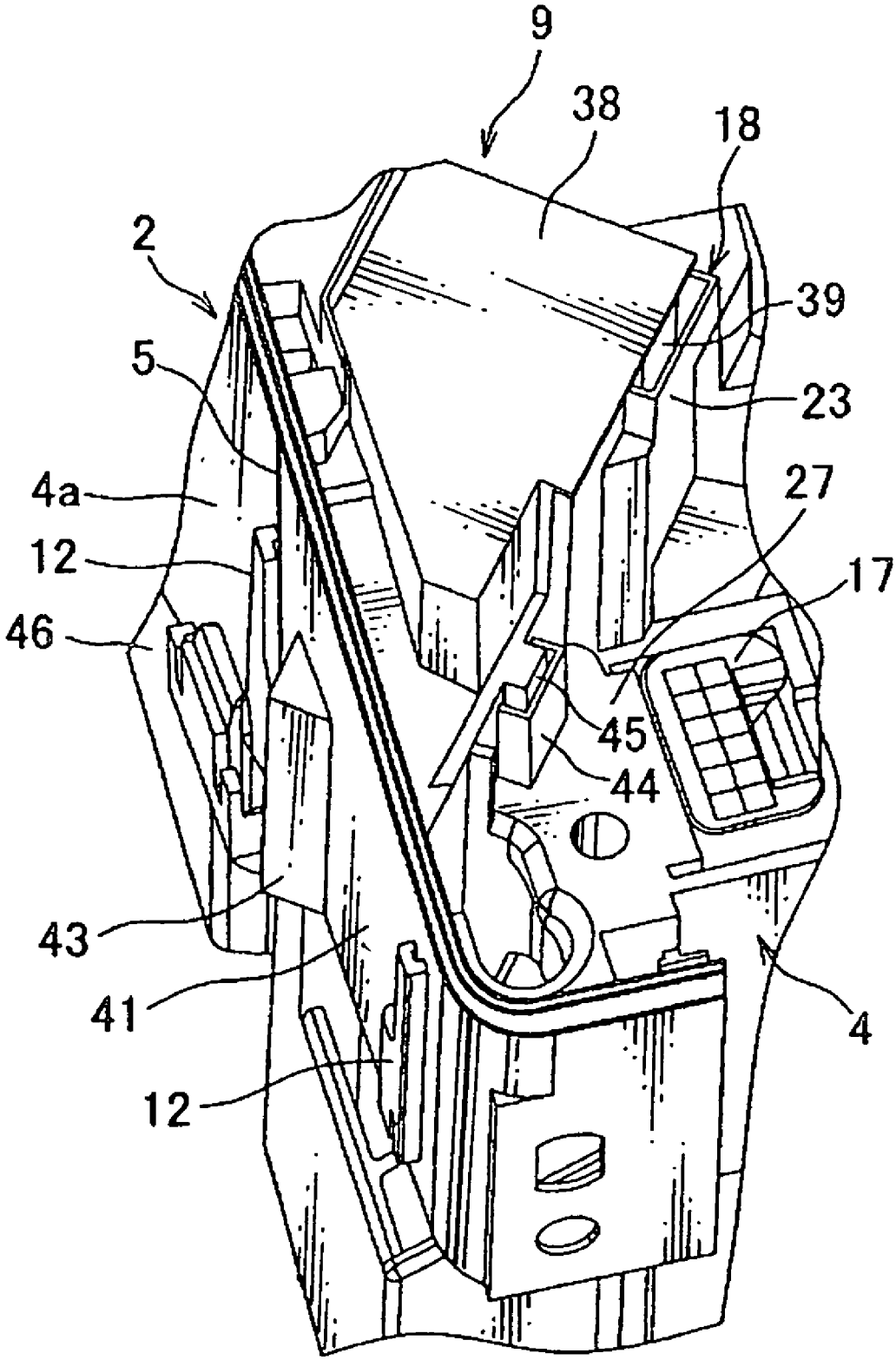
FIG. 2 is a perspective view showing a main area of the electric connection box shown in FIG. 1.

FIGS. 1, 2 show an embodiment of an electric connection box including a terminal lock device for a screw lock terminal according to the present invention. FIGS. 3-6 show an embodiment of the terminal lock device for the screw lock terminal.

As shown in FIG. 1, the electric connection box 1 includes a frame 2 made of an insulation resin (connection box main body), a fuse block 3 mounted inside the frame 2, an opening 5 provided at a side wall 4*a* of the frame 2, a bolt provided at the fuse block 3, a screw lock terminal 7 with an electric wire 8 fixed at an inner area of the opening 5 by the bolt 6, and a side cover 9 (cover) made of the insulation resin for covering the opening 5.

The frame 2 includes a rectangular vertical outer wall 4 (shell wall), and receiving sections 11 (receiving spaces) partitioned by partition walls and penetrating vertically inside the outerwall 4. The opening 5 is formed by cutting out vertically side wall 4*a* as a part of outer wall 4. A pair of guide rails 12 (guide) (FIG. 2) with an L-shape is formed projectingly outward at both side ends of the opening 5 so as to slide the side cover 9 from a top of the outer wall 4 and engage the side cover 9 with the outer wall 4. The fuse block 3 is received and locked from a bottom of the frame 2 into the receiving sections 11. An electronic board unit (not shown) is received and locked from a top of the frame 2 into the receiving section 11.

The fuse block 3 includes a block main body 13 made of the insulation resin, bus bars 14 (shown partially) made of a conductive metal and arranged in the block main body 13, a fusible link 15 connected between the bus bars 14 (the mating circuit), a blade fuse connected between clamp terminals (not shown) of the bus bars and a connector housing 17 receiving tab terminals (not shown) of the bus bars. The bus bar 14 (the mating circuit) has an exposed horizontal plate portion arranged at a terminal block 16 of the block main body 13.

A nut (not shown) is arranged inside the terminal block 16. The bolt 6 is inserted from the top of the terminal block 16 through a hole provided at the plate portion of the bus bar 14 and temporarily locked with the nut. The fuse block 3 in such condition is placed in the frame 2. Thus, the terminal block 16, the plate portion of the bus bar 14 and the bolt 6 are placed inside the opening 5 of the frame 2. A surrounding wall 18 (FIGS. 2, 3) with a U-shape in a plan view is provided above the terminal block 16 inside the opening 5. At the surrounding wall 18, a pair of flexible lock leaves 19 (FIG. 3) for locking a screw lock terminal 7 is arranged symmetrically in a horizontal direction.

Figure 3:
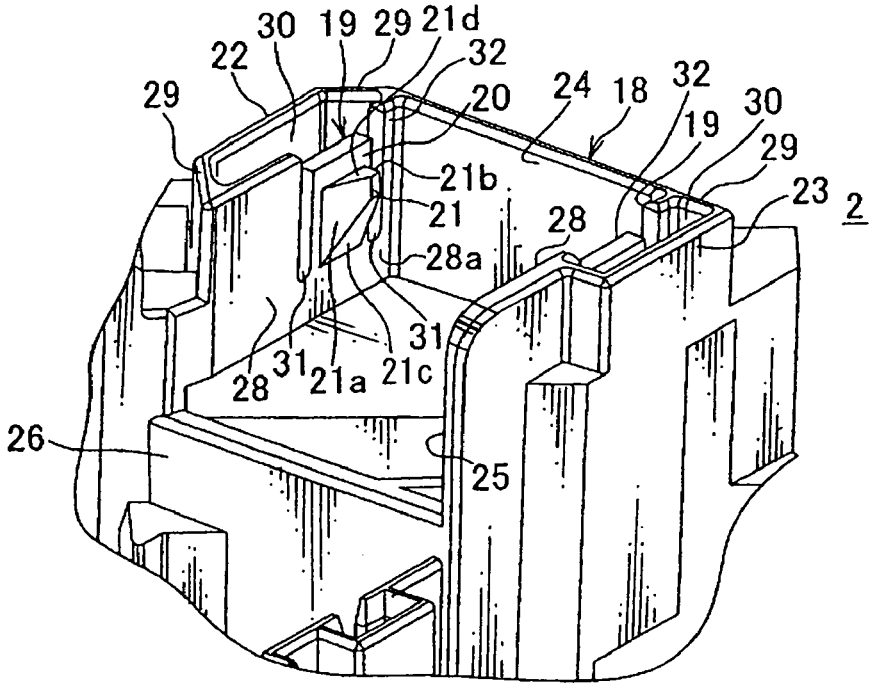
FIG. 3 is a perspective view showing a main area of a frame of the electric connection box shown in FIG. 1.

As shown in FIG. 3, the surrounding wall 18 is structured with vertical walls 22-24 at a right side, left side and rear side. A rectangular opening 25 is provided at a front side of the surrounding wall 18. An inside space formed by the surrounding wall 18 opens upward, downward and forward thereof. The surrounding wall 18 extends downward and is intersecting continued to a horizontal top wall 27 (FIG. 2) inside the outer wall 4 of the frame 2, together with a lower vertical wall 26 under the front opening 25.

Inner vertical walls 28 are provided in parallel to the vertical walls 22, 23 inside the vertical walls 22, 23. The vertical walls 22, 23 and the inner vertical walls 28 are connected with narrow front/rear end walls 29. Gaps 30 are formed between the inner vertical walls 28 and the vertical walls 22, 23. The lock leaf 19 is arranged at each inner vertical wall 28. A pair of vertical slits 31 is provided at the inner vertical wall 28 so as to form a flexible leaf 20 between the pair of slits 31. A lock hook 21 is arranged at an inner surface of each inner vertical wall 28. The flexible leaf 20 and the lock hook 21 forms the lock leaf 19. The flexible leaf 20 is structured shorter in the vertical direction than the inner vertical wall 28. The gap 30 corresponds to a bending space for bending the lock leaf 19.

The lock hook 21 is formed into a tetragonal pyramid shape with a front slant surface 21*a* (slide guide surface), a rear vertical surface 21*b* (lock surface), a lower moderate slant surface 21*c* and an upper steep slant surface 21*d*. A part of the inner vertical wall 28 adjacent to the slit 30 at a rear side corresponds to a vertical wall rib 32 projecting forward in a short length. The wall rib 32 has the same height as the inner vertical wall 28 and is continued perpendicularly to the vertical wall 24 at the rear side.

Figure 4:
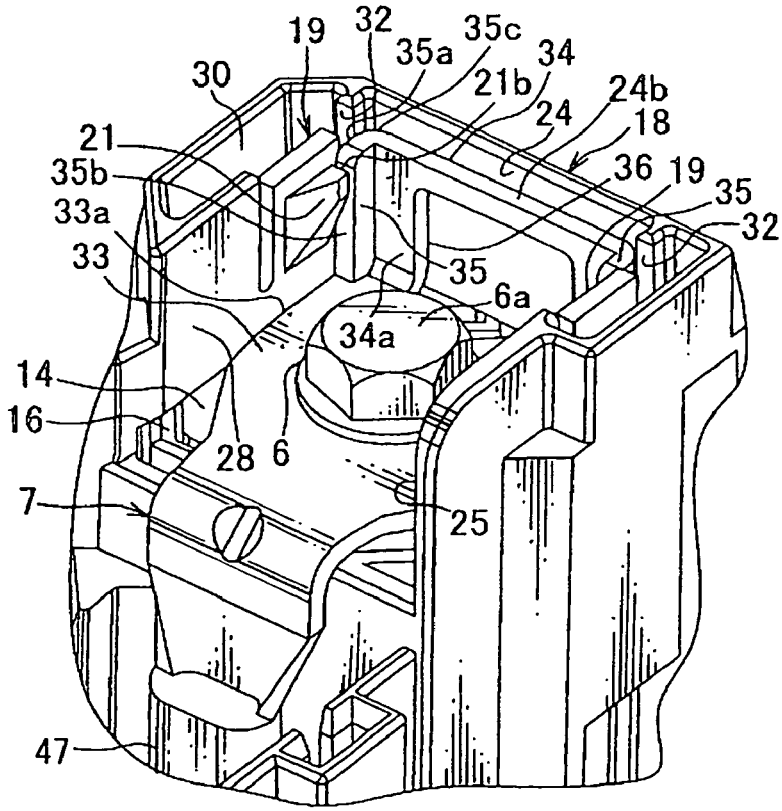
FIG. 4 is a perspective view showing the terminal locked and screwed at the main area of the frame shown in FIG. 3.
Figure 5:
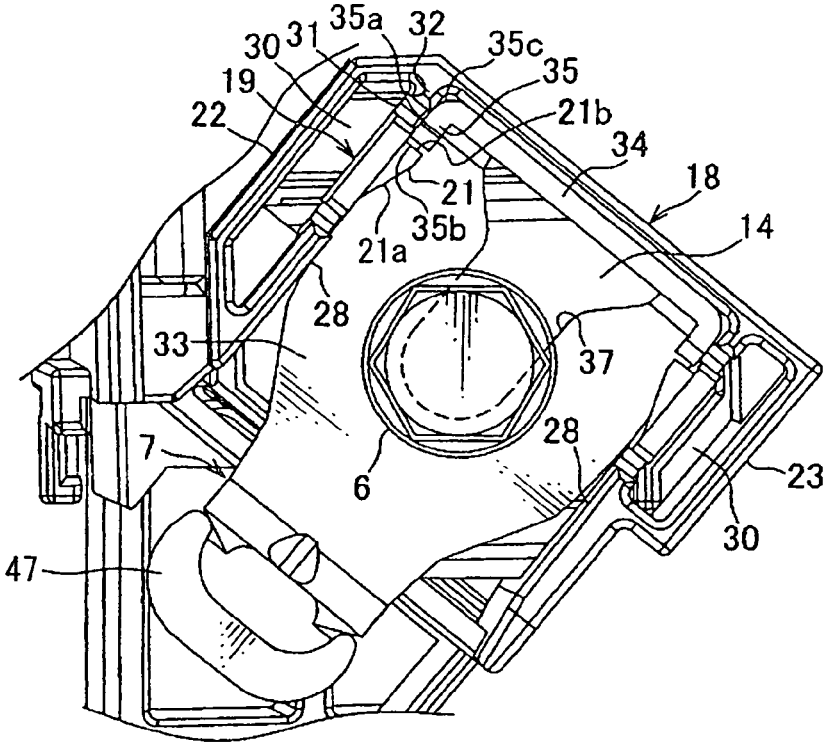
FIG. 5 is a plan view showing the terminal locked and screwed at the main area of the frame shown in FIG. 4.

In a condition of that the fuse block 3 is assembled from the bottom into the frame 2 as shown in FIG. 1, the horizontal plate portion of the bus bar 14 on the terminal block 16 is placed so as to touch a bottom end of the surrounding wall 18, as shown in FIGS. 4, 5. The bolt 6 is locked temporarily so as to have a gap between a bolt head 6*a* and the bus bar 14 for assembling the screw lock terminal 7, and the screw lock terminal 7 is inserted slidingly from the front opening 25 along a top surface of the bus bar 14 into the surrounding wall 18, and locked by the right/left lock leaves 19.

The screw lock terminal 7 includes a horizontal plate 33, a tab 34 extending vertically from a top end of the plate 33, and a wire crimp portion 47 continued vertically to a base end of the plate 33 by bending downward. The plate 33 is formed about a width to be wide at the top end thereof and to be narrow at the base end. A bottom surface of the plate 33 touches the top surface of the bus bar 14. The screw lock terminal 7 is placed so as to make substantially no gap between the both side ends 33*a* of the wide top end of the plate 33 and the inner surfaces of the inner vertical walls 28.

A rear surface of the tab 34 abuts on the inner surface of the vertical wall 24. Tab ribs 35 are extended perpendicular to the tab 34 from both ends of the tab 34 toward the front side by bending. The tab 34 is positioned stably at the lock leaves 19 to make substantially no gaps between outer surfaces 35*a* of the tab ribs 35 and inner surfaces of the wall ribs 32 perpendicular to the vertical wall 24 and between the outer surfaces 35*a* and inner surface areas 28*a* under the slits 31. The tab 34 is positioned to make substantially no gaps between front end surfaces 35*b* of the tab ribs 35 and the rear vertical surface 21*b* of the lock hook 21.

The tab 34 is formed with a U-shaped tab main body and the ribs 35. The tab main body includes a pair of vertical portions 34*a* symmetrically extending vertically from the horizontal plate 33 and a connecting portion 34*b* horizontally connecting both top ends of the pair of vertical portions 34*a*. Thereby, a vertical rectangular opening 36 for inserting the head of bolt therethrough is formed at the tab main body. The opening 36 is continued to a slot hole 37 (FIG. 5) of the horizontal plate 33 for inserting the bolt shaft.

The each tab rib 35 extends perpendicularly from each side end of the vertical portion 34*a* toward the base end of the horizontal plate 33 (frontward). An outer surface (rear surface) of the vertical portion 34*a* and an outer surface of the tab ribs 35 are continued smoothly to each other with around curved surface 35*c* (slide guide surface). The tab ribs 35 can reinforce the tab 34. When the terminal 7 is inserted in the surrounding wall 18, the curved surface 35*c* is slid on the front slant surface 21*c* of the lock hook 21 with a small friction force, and bends the lock leaf 19 outwardly in the gap 30 between the inner wall 28 and the vertical wall 22, 23. Just after the tab ribs 35 pass the lock hook 21, the lock leaf 19 returns elastically and the rear vertical surface 21*b* of the lock hook 21 controls the front end surface 35*b* of the tab rib 35 to be locked securely.

Since the tab 34 can pass the lock hook 21 with a small sliding force, the terminal 7 is prevented from incomplete lock. Thereby, decrease of contact area between the plate portion 33 of the terminal 7 and the bus bar 14 caused by the incomplete lock is prevented, so that reliability of electric connection between the terminal 7 and the bus bar 14. Removing the terminal 7 caused by vibration after complete screwing the bolt 6 can be prevented.

The outer surface 35*a* of the right/left ribs 35 are also controlled by the inner surface of the wall ribs 32 of the rear vertical wall 24 so that when the terminal 7 is rotated, the wall ribs 32 and the tab ribs 35 can support the terminal 7 so as to prevent rotation of the terminal 7. Thus, the terminal 7 is accurately positioned and the wire crimp portion 47 and the electric wire 8 (FIG. 1) are prevented from interference with the frame 2.

The electric wire 8 crimped with the terminal 7 is connected to an alternator or a converter of a car. When the terminal 7 is removed from the bolt 6 for maintenance, the bolt 6 is pulled out completely, and the terminal 7 is moved upward vertically, so that the horizontal plate 33 slides on the lower slant surface 21*c* of the lock hook 21 with a small force and is removed easily.

Figure 6:
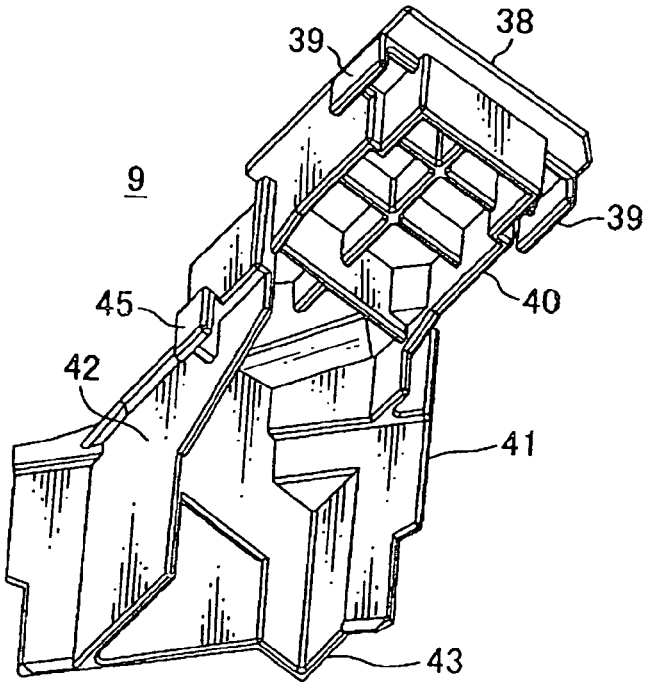
FIG. 6 is a perspective view from bottom showing a side cover covering the terminal of the electric connection box shown in FIG. 1.
Figure 7:
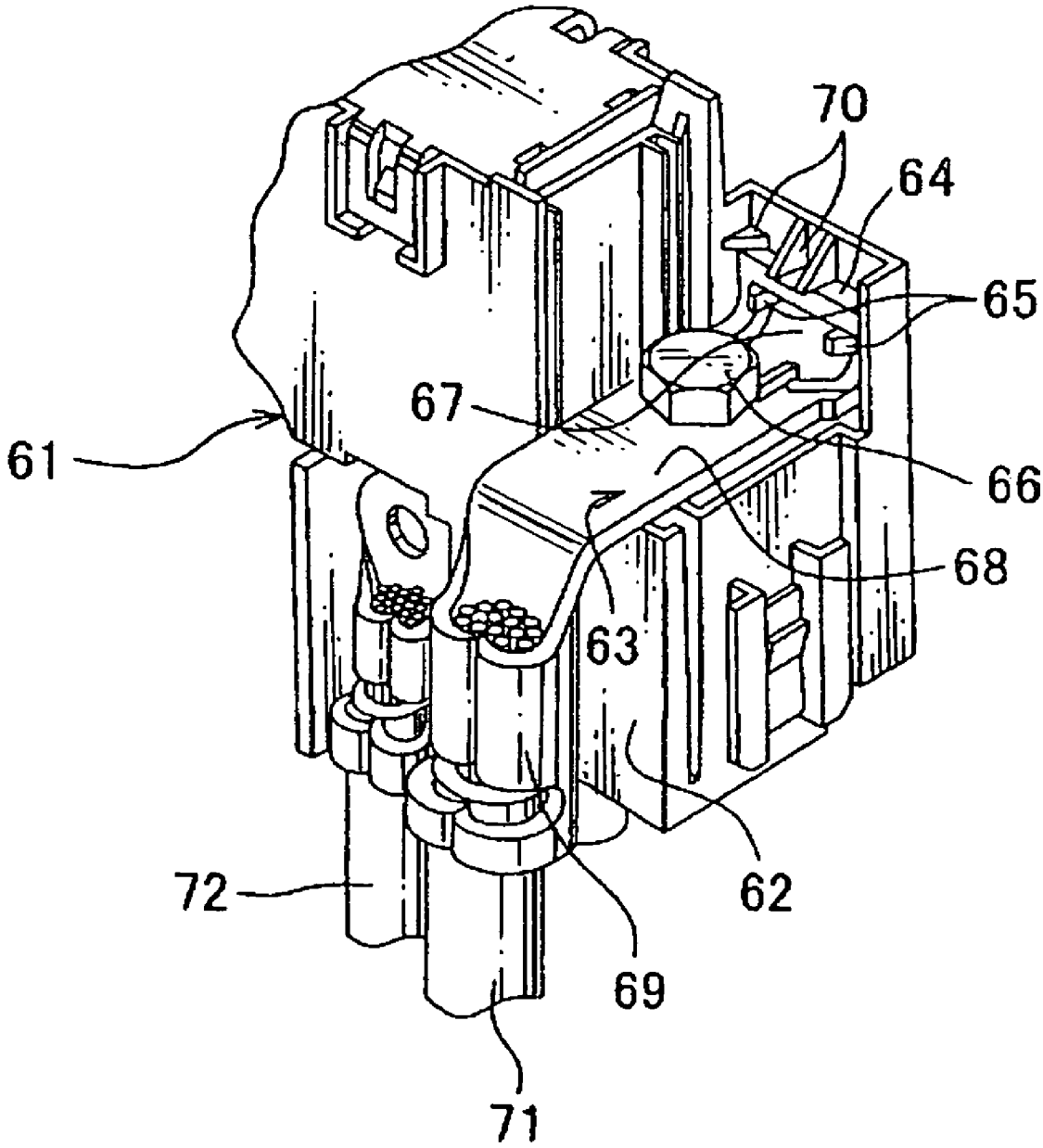
FIG. 7 PRIOR ART
FIG. 7 is a perspective view of an example of a terminal lock device for a screw lock terminal by prior art.

As shown in FIG. 2, the terminal 7 is assembled and the side cover 9 is attached on the frame 2. As shown in FIG. 6, the side cover 9 includes a horizontal top wall 38, a pair of projecting plates 39 extending downward vertically from both ends of the top wall 38, a frame wall 40 penetrating inside the inner wall 28 (FIG. 4) of the frame 2 so as to be located between the head of the bolt 6 and the inner wall 28 and abut on or near to the plate 33 of the terminal 7, a vertical outer wall 41 extending frontward and downward from the frame wall 40, and an inner wall 42 intersecting the outer wall 41 inside the outer wall 41 and being continued to the frame wall 40. The outer wall 41 has an expanding 43 for leading the electric wire. The inner wall 42 has a slide engage portion 45 for engaging with a short guide 44 at the horizontal top wall 27 (FIG. 2).

As shown in FIG. 2, the pair of projecting plates 39 penetrates into the gaps 30 at the surrounding wall 18 in FIG. 4 so as to prevent the lock leaves 19 from bending outward. Thereby, the terminal 7 after screwing the bolt 9 completely is locked securely. When the terminal 7 is incompletely inserted in the surrounding wall 18, and the lock hook 21 abuts on the tab ribs 35 of the terminal 7 so as to bend the lock leaves 19 outward, and the side cover 19 is tried to be attached at the frame 2, bottom ends of the projecting plates 39 abut on the lock leaves 19 and the side cover 9 cannot be attached at the frame 2. Thereby, incomplete lock of the terminal 7 can be detected. Operator can insert the terminal 7 in the surrounding wall 18 completely and the incomplete lock can be prevented. The electric wire 8 (FIG. 1) connected to the terminal 7 is guided downward along the expanding 43 of the side cover 9, without interference.

In FIG. 1, the fuse block 3 is mounted in the frame 2, and terminal 7 with the electric wire 8 is inserted from the opening 5 of the frame 2 along the bus bar 14 at the fuse block and locked temporarily by the lock leaves 19 of the frame 2. The terminal 7 is fastened to the bus bar 14 by screwing the bolt 6 completely. The side cover 9 is attached along the guide rails 12 of the frame 2 to the opening 5. The electric board unit (not shown) is assembled from the top of the frame 2 to the fuse block 3, and connectors with electric wires (not shown) are connected from the top and bottom of the frame. Covers are attached at the top and bottom of the frame 2 (only bottom cover 46 is shown in FIG. 2). This, the electric connection box 1 is structured.

The electric connection box 1 according to the present invention can includes additionally the fuse block 3, the frame 2 receiving the fuse block 3, the side cover 9 covering the opening of the frame 2.

Instead of the fuse block 3 in the above embodiment, a relay block or connector block can be applied. The fuse block 3, the relay block and the connector block can name generically as an electric connection block.

According to FIG. 4, the fuse block 4 and the frame 2 can be formed integrally. Or, The frame 2 made of insulation resin and the fuse block main body 13 are to be a connection box main body. By attaching the terminal 7 to the bus bar 14 along the connection box main body, and inserting the terminal 7 in the surrounding wall 18 of the connection box main body, and locking the terminal 7 at the lock leaves 19, the terminal 7 can be fastened by screwing the bolt 6 completely. As the mating circuit to be connected with the terminal 7, instead of the bus bar 14, o¥the other terminal or a circuit by in-molding can be applied.

While, in the embodiment, the present invention is described, it is not limited thereto. Various change and modifications can be made with the scope of the present invention.

The invention claimed is:

1. A terminal lock device for a screw lock terminal, comprising:

a connection box main body made of an insulation resin, the connection box main body comprising a surrounding wall, a pair of flexible lock leaves arranged at the surrounding wall, and a pair of bending spaces for bending each one of the pair of lock leaves;

a terminal with an electric wire, the terminal being connected to a mating circuit by screwing a bolt, the terminal comprising a tab to be locked at the pair of lock leaves, which the tab is structured for inserting a head of the bolt therethrough; and a cover covering the terminal, the cover being mounted at the connection box main body, the cover comprising a pair of projecting plates penetrating into each one of the bending spaces.

2. The terminal lock device according to claim 1, further comprising a pair of wall ribs at the surrounding wall adjacent to each one of the pair of lock leaves, and a pair of tab ribs provided at both sides of the tab, wherein inner surfaces of the pair of wall ribs and outer surfaces of the pair of tab ribs abut on each other when the terminal is locked at the lock leaves.

3. The terminal lock device according to claim 2, wherein an outer surface of the tab and the outer surfaces of the pair of tab ribs are continued to each other with a curved surface.

* * * * *